US006578892B2

(12) United States Patent
Tsimmerman

(10) Patent No.: US 6,578,892 B2
(45) Date of Patent: Jun. 17, 2003

(54) ARTICULATED LIFTING DEVICES FOR LIFTING OBJECTS UNDER OVERHANGS

(76) Inventor: Valery Tsimmerman, 2693 Wellworth Way, West Friendship, MD (US) 21794

( * ) Notice: Subject to any disclaimer, the term of this patent is extended or adjusted under 35 U.S.C. 154(b) by 0 days.

(21) Appl. No.: 10/011,668

(22) Filed: Oct. 30, 2001

(65) Prior Publication Data

US 2002/0050724 A1 May 2, 2002

Related U.S. Application Data

(60) Provisional application No. 60/244,433, filed on Oct. 31, 2000.

(51) Int. Cl.[7] ..... B66C 1/24

(52) U.S. Cl. ..... 294/67.21; 294/67.22; 294/67.5

(58) Field of Search ..... 294/67.1–67.22, 294/67.5, 81.1, 81.3, 81.4, 122–124

(56) References Cited

U.S. PATENT DOCUMENTS 2,063,040 A * 12/1936 Jolly ..... 294/82.12
2,329,008 A 9/1943 Smith
2,368,947 A 2/1945 Smith
3,427,066 A * 2/1969 Kugler ..... 294/67.3
3,843,185 A 10/1974 James et al.
3,998,488 A 12/1976 Durgan
4,475,758 A * 10/1984 Paulsson ..... 394/67.21
4,773,688 A 9/1988 Jones
4,950,012 A * 8/1990 Jones ..... 294/67.2
5,261,640 A 11/1993 Yuan
5,431,470 A 7/1995 Magerl et al.
5,556,148 A 9/1996 Skinner
5,775,753 A * 7/1998 Tetelboim ..... 294/67.21
5,871,247 A * 2/1999 Greenwell et al. ..... 294/67.5

OTHER PUBLICATIONS

Bradley Lifting Corporation Catalog, No Date (See Attached Catalog Cut).

* cited by examiner

*Primary Examiner*—Dean J. Kramer

(57) ABSTRACT

Articulated lifting device includes a generally orthogonal support frame having a forwardly extending adjustable lifting arm inserted through a sleeve at the top end of a downwardly extending telescopic leg, a plurality of interchangeable load adapters having elongated adapter arms and a connector that connects telescopic leg with any of the load adapters. The connector may be locked to create rigid frame connection or may be unlocked to allow pivotal movement of the connector in relation to the telescopic leg. An adjustable counterweight may be attached to free end of the adapter arm to balance weight of the heavy adapters. The lifting arm has a hookup point in order to suspend the lifting device off a crane or a hoist. The load adapters may thereby be attached to parts of machinery or other loads located under overhanging structures in order to remove or replace thereof.

15 Claims, 15 Drawing Sheets

ARTICULATED LIFTING DEVICES FOR LIFTING OBJECTS UNDER OVERHANGS

CROSS-REFERENCE TO RELATED APPLICATIONS

This application is entitled to the benefit of Provisional Patent Application Ser. No. 60/244,433, filed Oct. 31, 2000.

BACKGROUND

1. Field of the Invention

This invention relates to below the hook lifting devices, specifically to an improved lifting device capable of reaching spaces located under overhanging structures or machinery.

2. Description of Prior Art

In some instances it is necessary to lift heavy objects which are not directly accessible for the crane or hoist positioned above because of overhanging machinery or structures extending between hook of the hoisting device and the load.

To make this type of lifting operation possible, the prior art has resorted to the use of three basic types of lifting devices: an unbalanced rigid frames, an unbalanced mechanically or hydraulically adjustable frames and a balanced rigid frames.

Unbalanced rigid lifting frames utilize a principle of positioning hookup point, generally located at the end of top frame member, directly above center of gravity of the system which includes load and the frame. This type of lifting device is difficult to use because, when detached from load, such device hangs in the awkward position thus making attaching to and detaching from load unsafe and relatively difficult.

Unbalanced mechanically or hydraulically adjustable frames utilize same principle as rigid lifting frames described above except their configuration can be changed by human operator operating mechanical or hydraulic device in order to control shape of lifting frame. Although this type of lifting device is more preferable than rigid lifting frames, adjustable frames do not provide fixed predetermined positions of frame members in relation to each other thus making process of adjustment slow and tiresome. Because of mechanical and/or hydraulic moving systems such devices are relatively expensive and require additional maintenance. Hydraulically adjustable frames also have hydraulic hoses which limit their movement and create additional safety concerns.

In order to ensure correct position while being suspended, balanced rigid frames are equipped with counterweights, generally located at one end of top frame member. This type of lifting frames utilizes principle of positioning hookup point of the lifting device, generally located intermediate the ends of top frame member, directly above center of gravity of the object being lifted. Counterweight has to be heavy enough in order to balance total weight of the lifting device thus making said counterweight relatively heavy and also reducing lifting capacity of the system. In order to make such lifting frame adjustable in regard to horizontal reach, counterweight, which is difficult to reach because of its location on the upper frame member, also has to be made adjustable thus significantly complicating construction and operation of lifting device.

Other disadvantages of the prior art are associated with relatively complicated structure and frame member connections which do not allow quick assembly, disassembly and wide range adjustments often desirable for efficient use and storage of lifting devices.

SUMMARY

In accordance with the present invention a lifting device comprises a generally orthogonal support frame having a downwardly extending telescopic leg and a forwardly extending adjustable lifting arm with a hookup point for connecting to an overhead hoisting device, a plurality of interchangeable load adapters having elongated adapter arms and a connector connecting said orthogonal frame with said adapter arms having means which human operator can manipulate to restrict or to free pivotal movement thereof thereby allowing to make connection to adapter arm rigid, when said adapter is attached to the load, or pivotal, as necessary for precise positioning and handling of lifting device prior to and after the lift. In a preferred embodiment of present invention, a counterweight assembly is attached to the rear end of adapter arm in order to balance weight of relatively heavy adapters.

In the construction of present invention, load adapter is directed towards the load and lifting arm of orthogonal support frame extends in the same direction. The lifting arm of the orthogonal support frame may thereby be connected to a suitable overhead hoisting device or a crane. The connector at the bottom of the leg of the support frame may be made free to rotate allowing easy connecting to the adapter arm of the load adapter. After load adapter is attached to the load and connector is connected to the adapter arm, the orthogonal support frame may be rotated about pivot point of the connector in the direction of the load by moving crane above and subsequently locked in a predetermined position thus completing preparation for the lift.

These and other objects of the present invention will become apparent from a reading of the following specification taken in conjunction with the enclosed drawings

BRIEF DESCRIPTION OF THE DRAWINGS

FIG. 19 is an elevational view of an articulated lifting device being assembled with a water jet adapter/counterweight assembly.

FIG. 20 is an elevational view of an articulated lifting device, suspended off a crane hook and being prepared for attachment to a water jet which is mounted in a boat.

FIG. 21 is an elevational view of articulated lifting device, attached to a water jet, with a telescopic leg fixed in final position and also in the position preceding final (shown in phantom lines), when telescopic leg and connector are pivoted.

FIG. 22 is an elevational view of an articulated lifting device, suspended off a crane hook and being moved away from a boat with a water jet attached to it.

FIG. 23 is an elevational view of an articulated lifting device being detached and moved away from a water jet which is set in a cradle.

FIG. 24 is a side view of a crawler drive adapter being attached to a drive of a crawler tractor supported on wooden blocks in a maintenance shop, with a crawler removed and a drive ready for replacement.

FIG. 25 is an end view of a crawler drive adapter.

FIG. 26 is an elevational view of an articulated lifting device ready to be attached to a drive adapter.

FIG. 27 is an elevational view of an articulated lifting device with a crawler drive attached to it shown suspended off a crane hook and being moved away from a tractor.

DESCRIPTION OF THE PREFERRED EMBODIMENT

Figure 1:
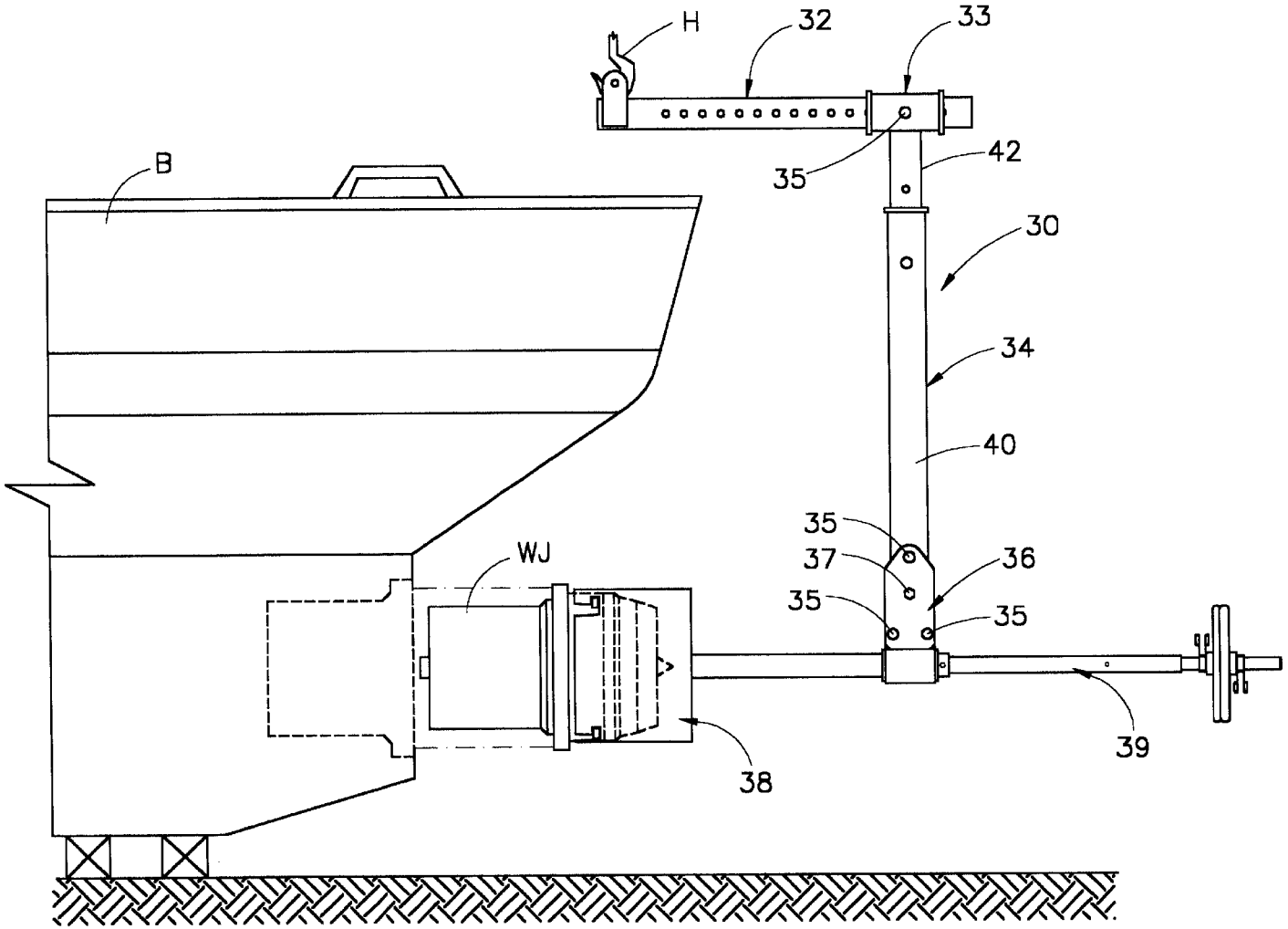
FIG. 1 shows an elevation of an articulated lifting device being used to remove a water jet from a boat.
Figure 10:
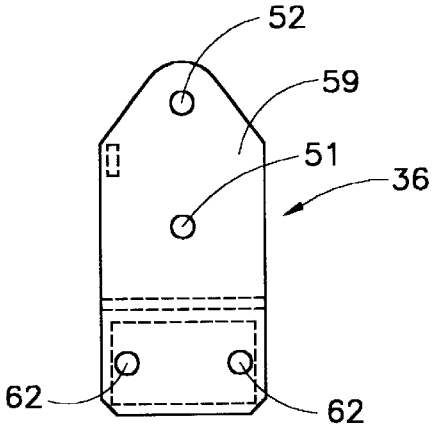
FIG. 10 is an elevation of a connector.
Figure 11:
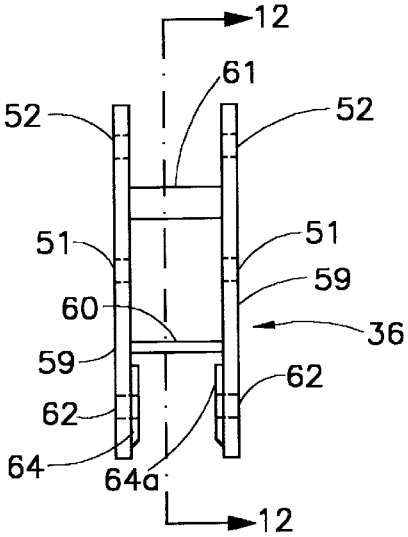
FIG. 11 is an end view thereof.
Figure 12:
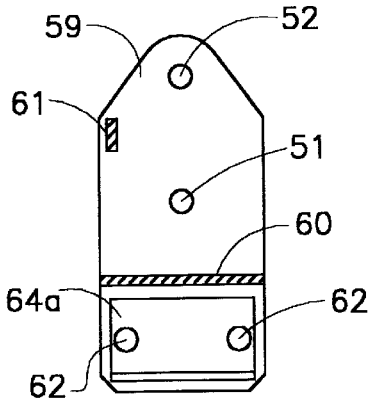
FIG. 12 is a sectional view of a connector taken along the longitudinal axis thereof.

In FIG. 1, an articulated lifting device 30 of the present invention is shown as being used to remove a water jet WJ from a boat B, which is supported on wooden blocks in the dry dock or on shore. Aft of a boat B overhangs water jet WJ, thus making the water jet inaccessible directly from a hook H of a lifting mechanism above. Articulated lifting device 30 is a frame that consists of an adjustable lifting arm 32, also shown in a greater detail in FIGS. 8–9, that is inserted in a sleeve 33 at the top of a telescopic leg 34, shown in greater detail in FIGS. 2–5, thus creating a rigid connection that also allows adjustment of the lifting arm extension. A removable pin 35, which is inserted through sleeve 33 and lifting arm 32, prevents the lifting arm from sliding within sleeve 33. A connector 36, shown in greater detail in FIGS. 10–12, is rigidly connected to the bottom of telescopic leg 34 with removable pin 35, also shown in FIG. 4, and a pin 37. In the preferred embodiment, the pin 37 is a bolt with a lock nut which is inserted through connector 36 and telescopic leg 34 in such a manner that allows free rotation of connector 36 around pin 37 when removable pin 35 is not installed. In the preferred embodiment ⅞" diameter pins are used.

Figure 20:
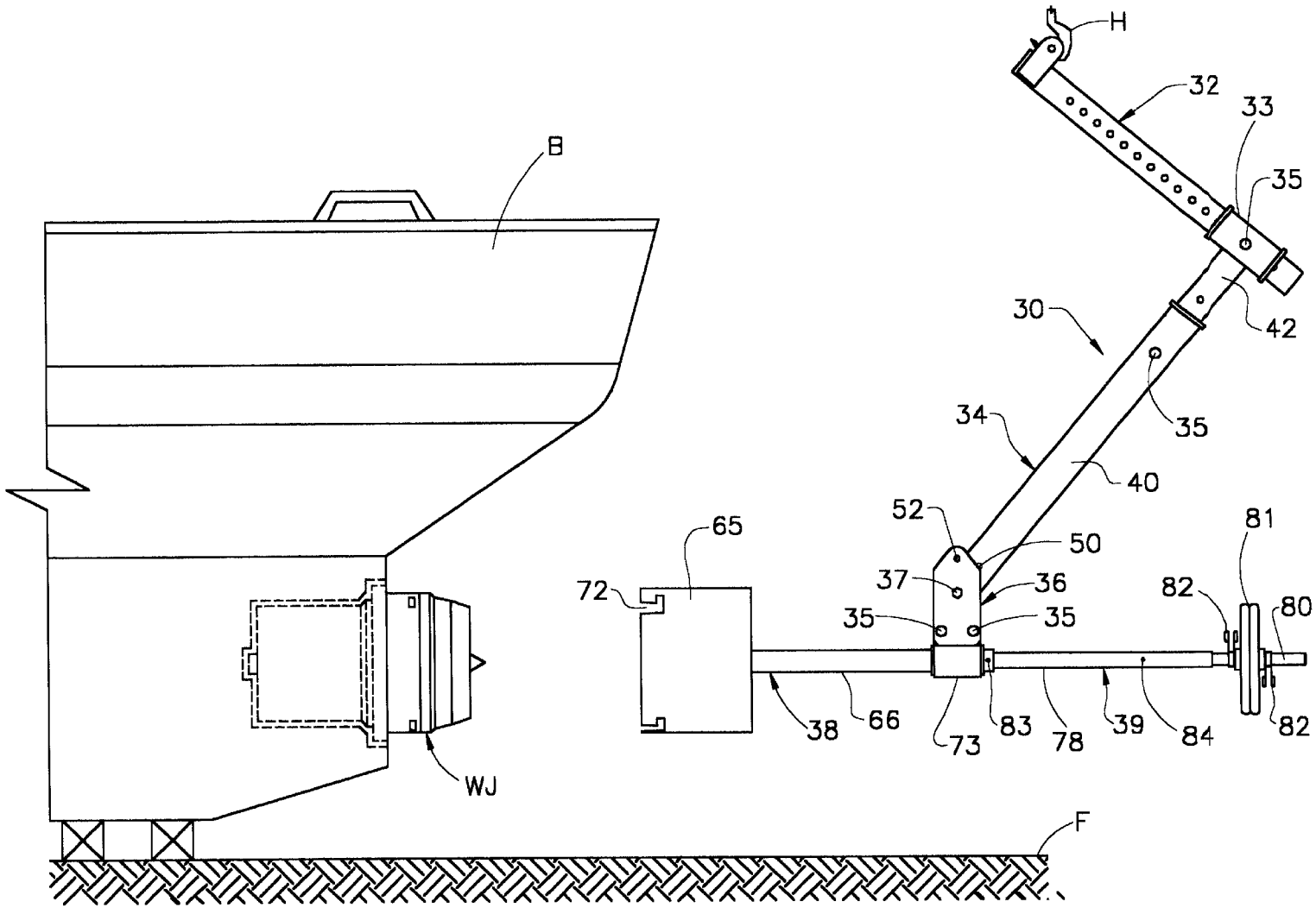
Figure 21:
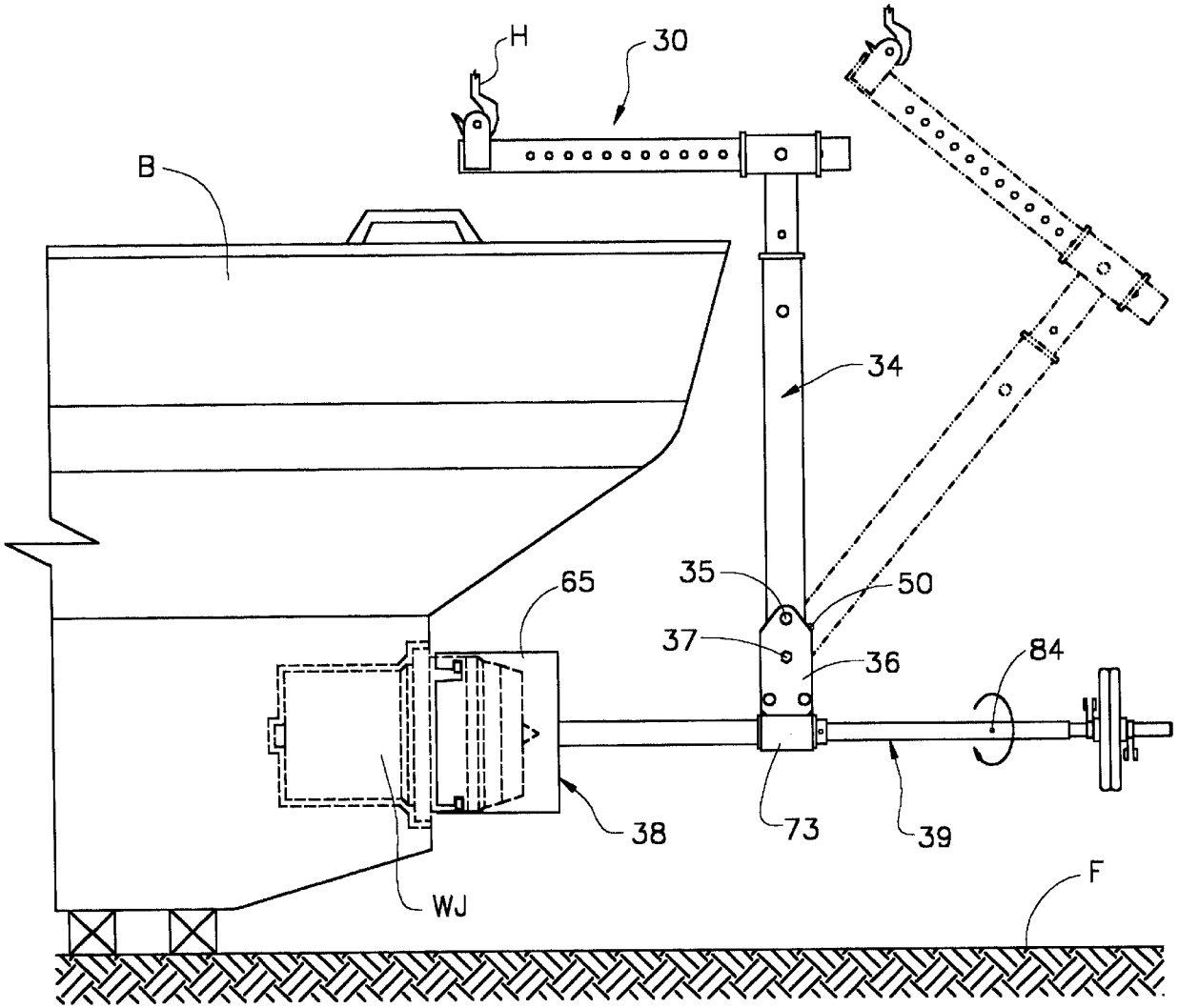

Connector 36 can be attached to interchangeable load adapters. Each load adapter would be specifically designed to fit certain parts or loads that need to be lifted. In the described embodiment, a water jet adapter 38, which is presented in detail in FIGS. 13, 15–18, is shown attached to the bottom of connector 36 with two removable pins 35. Heavy load adapters, such as water jet adapter 38, that cannot be manually handled due to their excessive weight, can be moved into position and attached to the load with the help of the articulated lifting device, which is the subject of this invention, equipped with an adjustable counterweight assembly 39 to balance the weight of such load adapter. Counterweight assembly 39 is adjusted to keep water jet adapter 38 level for the ease of attachment to water jet WJ as illustrated in FIGS. 20–21 and as explained below in the section entitled "Operation of Preferred Embodiment".

Figure 2:
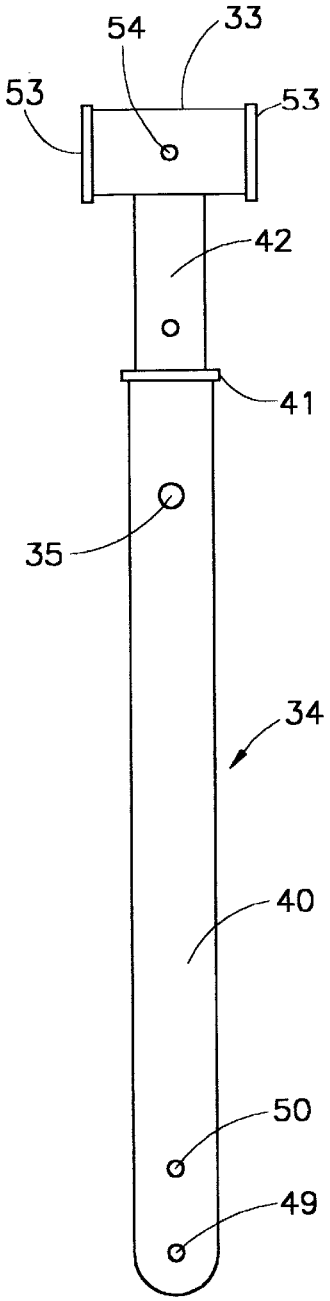
FIG. 2 shows front elevation of a telescopic leg of an articulated lifting device, drawn to an enlarged scale.
Figure 3:
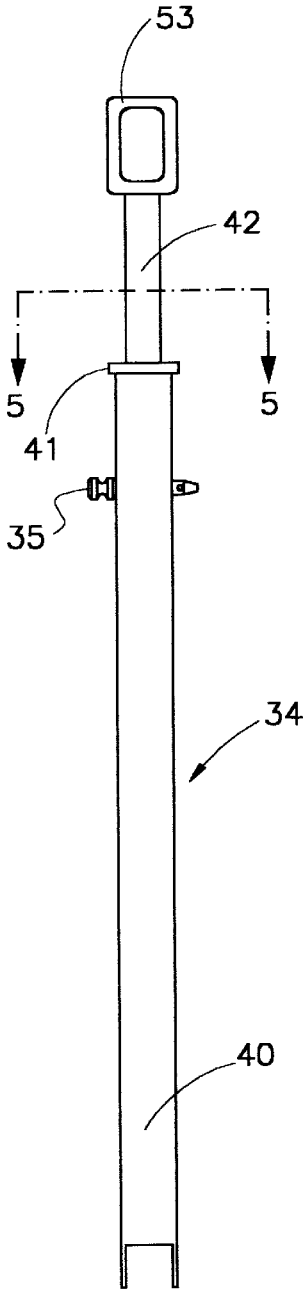
FIG. 3 is a side view thereof.
Figure 6:
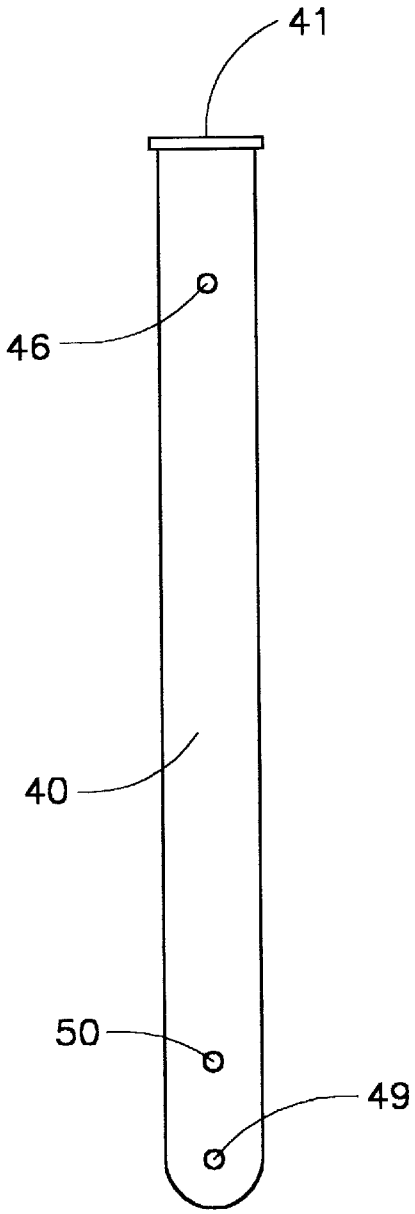
FIG. 6 is an elevation of the bottom/outer part of the telescopic leg.
Figure 7:
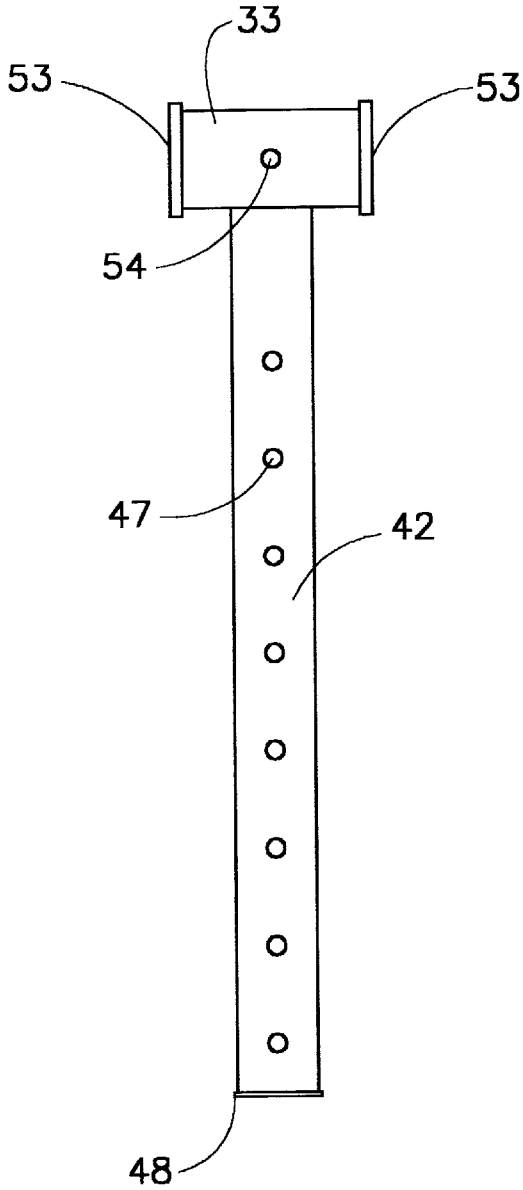
FIG. 7 is an elevation of the top/inner part thereof.

FIGS. 2 and 3 show elevation (front) and side view of telescopic leg 34 respectively. Telescopic leg 34 comprises an outer tube 40 and inner tube 42 that telescopes within outer tube 40. In a preferred embodiment both tubes are rectangular cross section. A removable pin 35 (FIG. 4) is inserted in aligned holes through tubes 40 and 42, thereby assembling the tubes together. Removable pin 35 has machined head 44 with a groove that conforms to the shape of fingers to facilitate removal and installation of the pin. Quick Release Ball Lock Pin (not shown), as supplied by Reid Tool Supply Company R fits in cotter pin hole 45 to prevent accidental fallout of pin 35 and to facilitate easy removal and installation of the pin. FIGS. 6 and 7 show details of outer tube 40 and inner tube 42. Outer tube 40 has a hole 46; correspondingly, tube 42 has a plurality of vertically spaced apart holes 47. By aligning hole 46 of outer tube 40 with one of the holes 47 of inner tube 42 and inserting pin 35 through aligned holes the overall length of telescopic leg 34 can be adjusted. A plate 41(FIGS. 2–6), which has a cutout that is slightly larger than the exterior dimensions of inner tube 42 is welded to the top end of outer tube 40. The purpose of plate 41 is to center inner tube 42 within outer tube 40 at the top of the outer tube. Plate 48, welded at the bottom of inner tube 42 as shown in FIG. 7, conforms to interior dimensions of outer tube 40, only slightly smaller, to allow free movement within outer tube 40 and to center the bottom end of inner tube 42 inside outer tube 40.

Figure 4:
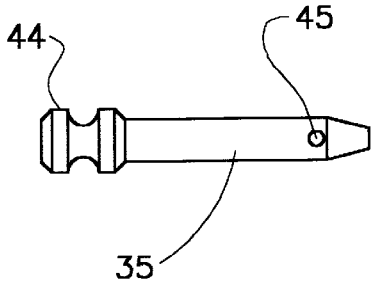
FIG. 4 is an elevational view of removable pin.
Figure 5:
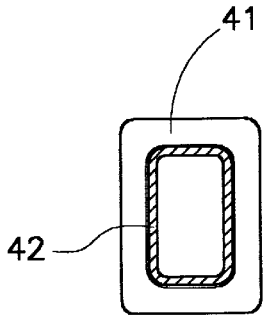
FIG. 5 is a cross-sectional view of the top portion of the telescopic leg.

Sleeve 33 is attached to the top end of tube 42 as shown in FIGS. 1–3 and 7. In the preferred embodiment, sleeve 33 comprises 6"×4" tubular section which is approximately 12" long and is welded to the top end of tube 42. End plates 53 are welded to both ends of sleeve 33. Each of the end plates 53 has a cutout, similarly to plate 41 (see FIG. 5), to accept lifting arm 32, shown in FIGS. 8 and 9, and to center it within sleeve 33. Hole 54 (FIG. 7), drilled through the walls of sleeve 33, aligns with one of the plurality of spaced apart holes 55 (FIG. 8), drilled through the walls of lifting arm 32, thus making the extension of lifting arm 32 adjustable. Removable pin 35 shown in FIG. 4 is inserted through the aligned holes 54 and 55, preventing sliding of lifting arm 32 within sleeve 33 (FIG. 1). To adjust lifting arm extension, pin 35 has to be removed, lifting arm 32 has to be pushed in or out to obtain desirable extension and to align hole 54 of sleeve 33 (FIG. 7) with the closest of holes 55 of lifting arm 32 (FIG. 8), then pin 35 is reinstalled to fix lifting arm 32 in desirable position.

Figure 8:
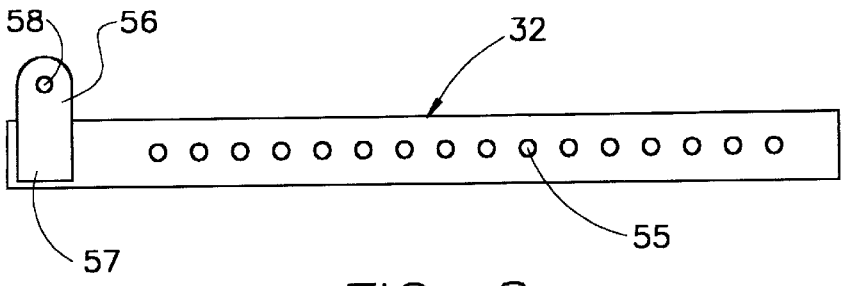
FIG. 8 is an elevation of a lifting arm.
Figure 9:
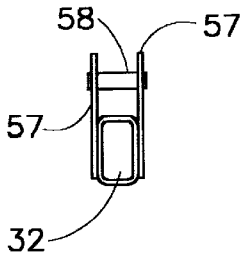
FIG. 9 is an end view thereof.

FIGS. 8 and 9 are elevation and end views of lifting arm 32 respectively which, in the preferred embodiment, comprises a 5"×3" rectangular tube, approximately 5' long, with plurality of spaced apart holes 55 drilled through both walls of the tube. A lifting point 56 comprises two plates 57 welded to the opposite side of the tube at the end of lifting arm 32. A lifting pin 58 comprises a steel bar of cylindrical shape. Lifting pin 58 is inserted through holes in both plates 57 and welded all way around to the plates 57, thus providing the hook up point for the crane or hoist.

Outer tube 40 has a pair of spaced apart holes 49 and 50, as shown on FIGS. 2 and 6. Hole 49 aligns with hole 51 of connector 36 (FIGS. 10–12) to accept pin 37, as shown in FIG. 1, thus permanently connecting telescopic leg 34 with connector 36. In a preferred embodiment, pin 37 comprises a hex bolt with a lock nut. Hole 50, which in preferred embodiment is located above hole 49 at the bottom part of outer tube 40 (FIGS. 2 and 6), aligns with hole 52 of connector 36 (FIGS. 10–12) so that removable pin 35 can be inserted. When pin 35 is installed through holes 50 and 52 of outer tube 40 and connector 36 respectively, swivel action of connector 36 is restrained. On the contrary, when pin 35 is removed connector 36 is able to rotate around permanent pin 37 (FIGS. 1, 20 and 21). The bottom end of outer tube 40 is rounded, as shown on FIGS. 2 and 6, to facilitate rotation of connector 36. (In the preferred embodiment the length of telescopic leg 34 can be adjusted between 6' and 9.5', the size of outer tube 40 is 6"×4" with 5/16" wall and the size of inner tube 42 is 5"×3" with 5/16" wall).

FIGS. 10 and 11 show elevation and end view of connector 36 respectively. FIG. 12 is a cross-sectional view taken along the longitudinal axis of connector. Connector 36 comprises two spaced apart plates 59 connected together through spacer plate 60 and stop plate 61, which also limits angle of rotation of the connector. Two spaced apart holes 62 are drilled or punched in each plate 59. In the preferred embodiment holes 62 align with respective holes 63 of water jet adapter 38, shown in FIG. 13, to accept two removable pins 35. This allows easy attachment of the adapters to the connector 36 as well as quick replacement thereof. Reinforcement plates 64 and **64*a* (provided with the holes to match holes 62) are welded to inside faces of plates 59 in order to strengthen them in the areas around the holes. Bottom edges of plates 64 and 64*a*** are beveled to facilitate easy installation of the interchangeable adapters.

Figure 13:
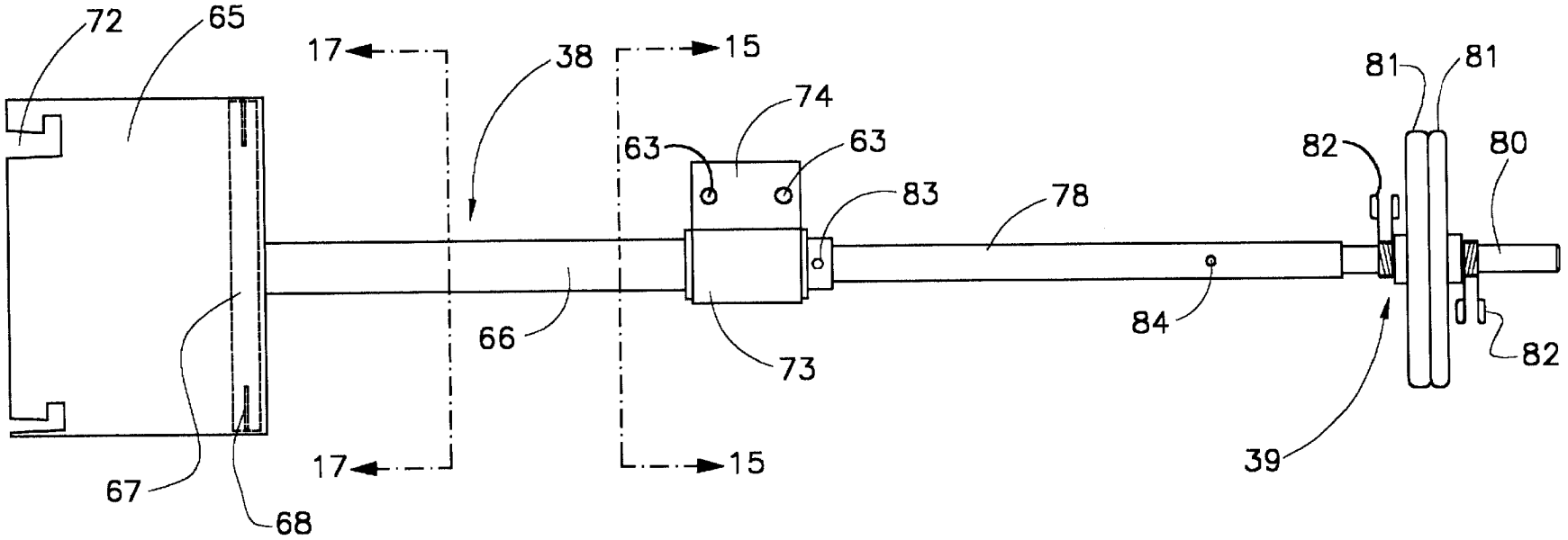
FIG. 13 is an elevation of a water jet adapter assembled together with a counterweight assembly.
Figure 14:
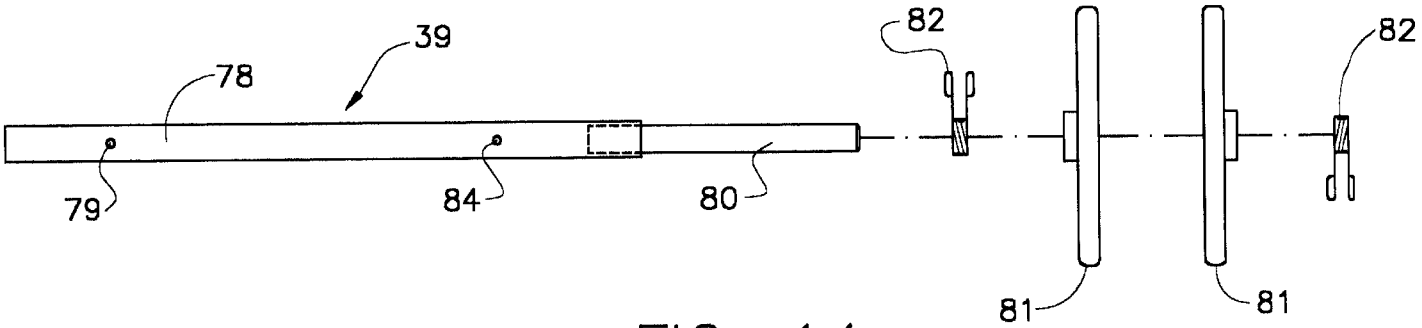
FIG. 14 is an exploded view of a counterweight assembly.
Figure 16:
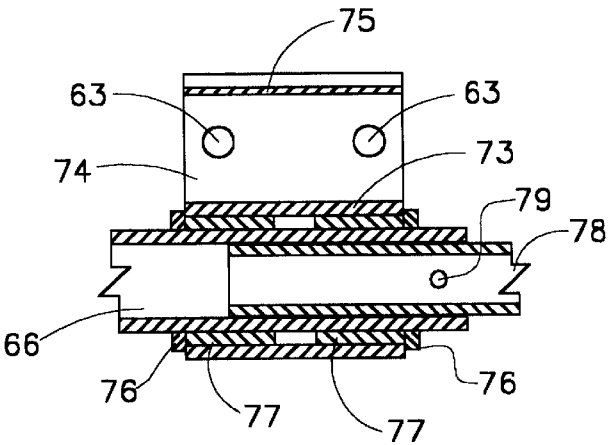
FIG. 16 is a sectional view of an adapter-to-counterweight arm connection taken along longitudinal axis thereof.
Figure 15:
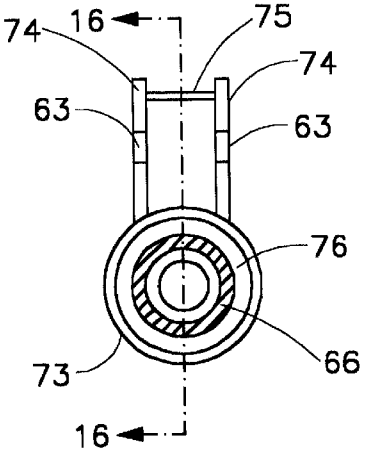
FIG. 15 is a cross-sectional view of a tubular arm of a water jet adapter.

With the reference to FIGS. 13–16, water jet adapter 38 assembles together with counterweight assembly 39 which can be adjusted to balance the adapter with respect to the permanent pin 37 so that it hangs in almost a level position regardless of the position of telescopic leg 34 (FIG. 20). In the preferred embodiment, water jet adapter 38 comprises an attachment head 65 at the end of a round tube 66 which is inserted through a sleeve 73 (FIG. 13). Spaced apart plates 74 are welded to the top of sleeve 73 (FIGS. 15 and 16). Spacer plate 75 is welded between plates 74. Pair of holes 63 are provided in each plate 74 which align with holes 62 of connector 36 to receive two removable pins 35. Round tube 66 is rotatably journaled in oil-impregnated bronze bearings 77 within sleeve 73 (see FIG. 16). Two stop rings 76 are welded to round tube 66 at either end of sleeve 73 to keep the sleeve from moving along the tube 66.

With the reference to FIG. 14, counterweight assembly 39 comprises a tubular counterweight arm 78, a round bar 80 (preferably 2" diameter), weight plates 81 that are threaded on round bar 80 and fixed in the desirable position with spring clamps 82. (In the preferred embodiment standard olympic size weight lifting hardware is used for counterweight). Outside diameter of counterweight arm 78 is slightly smaller than inside diameter of tube 66 so, it can be inserted into the free end of tube 66 of the water jet adapter (see FIG. 16). End portion of round bar 80 (preferably 2"0 diameter) is inserted into the end of counterweight arm 78 and welded to it with circumferential fillet weld (FIG. 14). In order to assemble water jet adapter with counterweight assembly, the end of counterweight arm 78 is inserted into the end of tube 66 and pinned together with a bolt 83 inserted through a hole 79 as shown in FIGS. 13 and 16. Through hole 84 is provided in counterweight arm 78 where a pry bar (not shown) can be inserted in order to turn water jet/counterweight assembly around its longitudinal axis within sleeve 73. In the preferred embodiment outside diameter of counterweight arm 78 is 2⅝" that fits inside round tube 66, outside diameter of which is 3¾". In the preferred embodiment, total length of counterweight assembly is approximately 5'–6", approximate total weight of plates 81 is ninety pounds and total length of water jet adapter 38 is approximately 5'.

Figure 17:
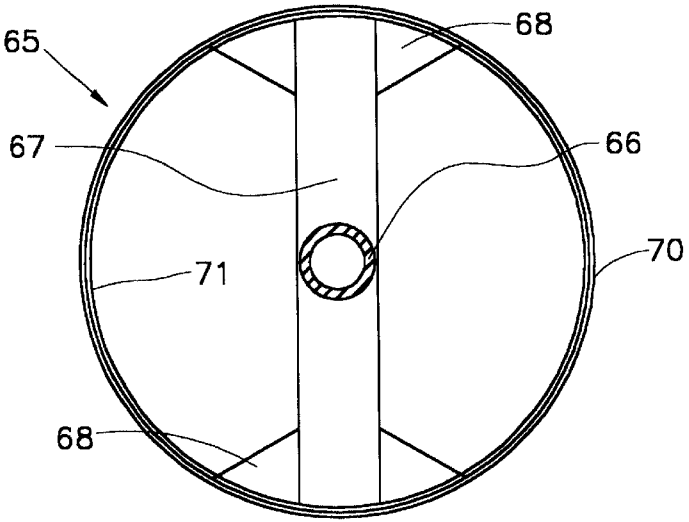
FIG. 17 is a cross-sectional view of an adapter tubular arm of a water jet adapter, looking towards an attachment head thereof.
Figure 18:
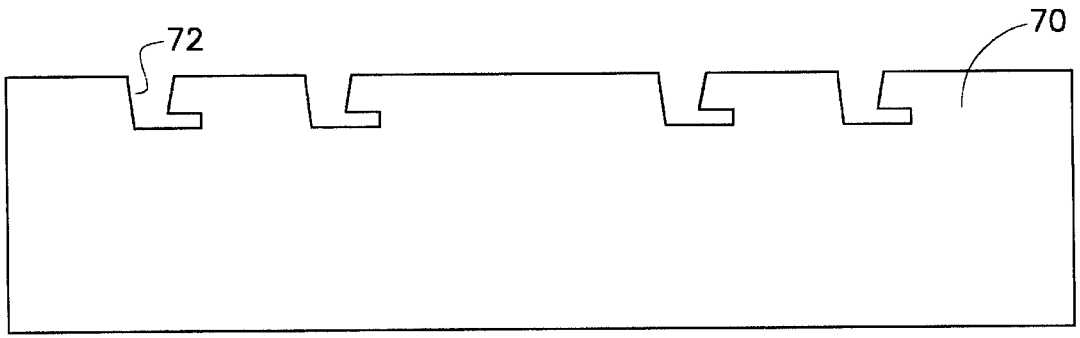
FIG. 18 is an unfolding of a rolled plate attachment head of an adapter.

With the reference to FIGS. 13, 17 and 18, attachment head 65 comprises steel plate 70, rolled into tubular shape. The inside surface of attachment head 70 is lined with rubber or neoprene sheet 71 to prevent damage to the surface of water jet WJ shown in FIG. 1. Cutouts 72 are provided in plate 70 and in rubber liner 71 (see FIGS. 13 and 18). These cutouts engage lifting lugs of the water jet WJ thus attaching water jet adapter 38 to the water jet as shown on FIG. 1. A spreader 67 comprises rectangular tube which is attached to the end of round tube 66, cross-section of which is shown in FIG. 17, with circumferential fillet weld. Ends of spreader 67 are rounded to conform to the inside surface of rolled plate 70. Spreader 67 is attached to the inside surface of rolled plate 70 with fillet weld at the end of the rolled plate 70 which is opposite to cutouts 72. Gusset plates 68 are provided at the center line of spreader 67 to reinforce rolled plate 70 at the connections with spreader 67. In the preferred embodiment, inside diameter of the attachment head 65 is approximately 25", that is 1" bigger then outside diameter of the water jet WJ.

OPERATION OF PREFERRED EMBODIMENT

Figure 22:
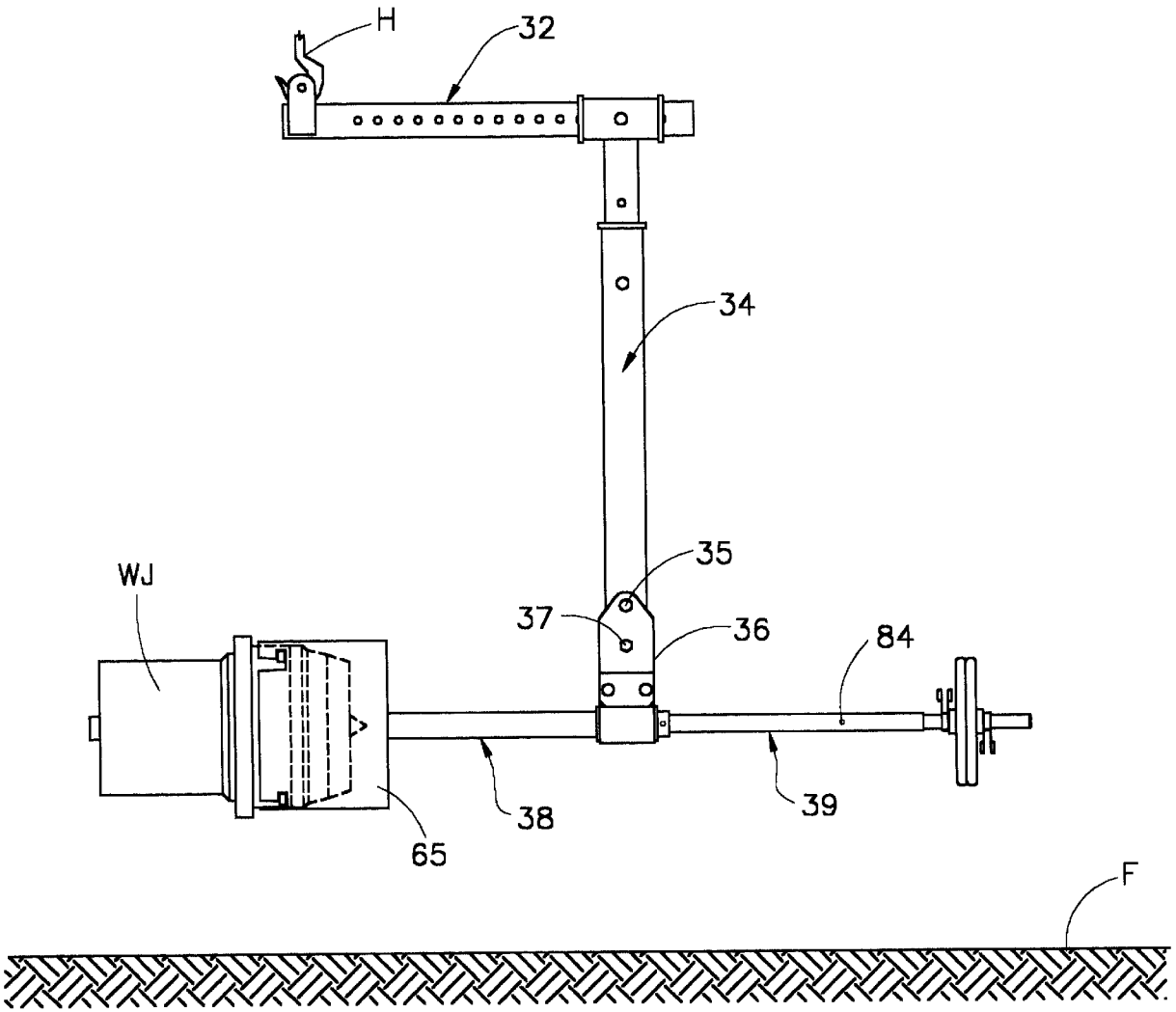

FIGS. 19 through 24 illustrate operation of the preferred embodiment of the present invention. Before using the articulated lifting device, position of the Center of Gravity of the Water Jet WJ shall be determined. Knowing the weights of every part of the lifting device and making assumptions in regard to the extension of adjustable lifting arm 32, the Center of Gravity of the articulated lifting device 30 in combination with Water Jet WJ attached to it, as well as extension of lifting arm 32, can be found, unless it is already known from previous experience. Extension of adjustable lifting arm 32 shall be such as to position the hook of the crane or hoist directly above the Center of Gravity of lifting device 30 combined with Water Jet WJ while in working position, as illustrated in FIG. 22. Positioning the hook H of the hoist or crane directly above the Center of Gravity of the lifting device and Water Jet combination will assure that Water Jet WJ as well as lifting arm 32 and adapter 38 will be in the position close to level, while suspended off the hook H. When extension of adjustable lifting arm 32 is determined, appropriate mark, indicating extension of the arm 32 for this type of lift, shall be made on its face with a permanent marker for future use in order to eliminate the necessity of finding the Center of Gravity every time the Water Jet is lifted.

To prepare articulated lifting device 30 it shall be placed on a pallet or floor F. Pin 35, connecting adjustable lifting arm 32 with telescopic leg 34, shall be removed and extension of the lifting arm 32 shall be adjusted, then pin 35 shall be reinstalled in aligned holes in the lifting arm 32 and sleeve 33. The length of telescopic leg 34 can also be adjusted if necessary by removing pin 35, which connects tubes 40 and 42, and sliding tube 40 in or out until desirable length of the leg is achieved. Pin 35 shall be reinstalled in aligned holes of the tubes 40 and 42. Separately, water jet adapter 38 and counterweight assembly 39 shall be connected together by inserting the end of the counterweight arm 78 into the end of tube 66 as shown in FIGS. 13 and 19.

Bolt 83 shall be inserted through aligned holes 79 in both counterweight arm 78 and tube 66, thus connecting them together.

Figure 19:
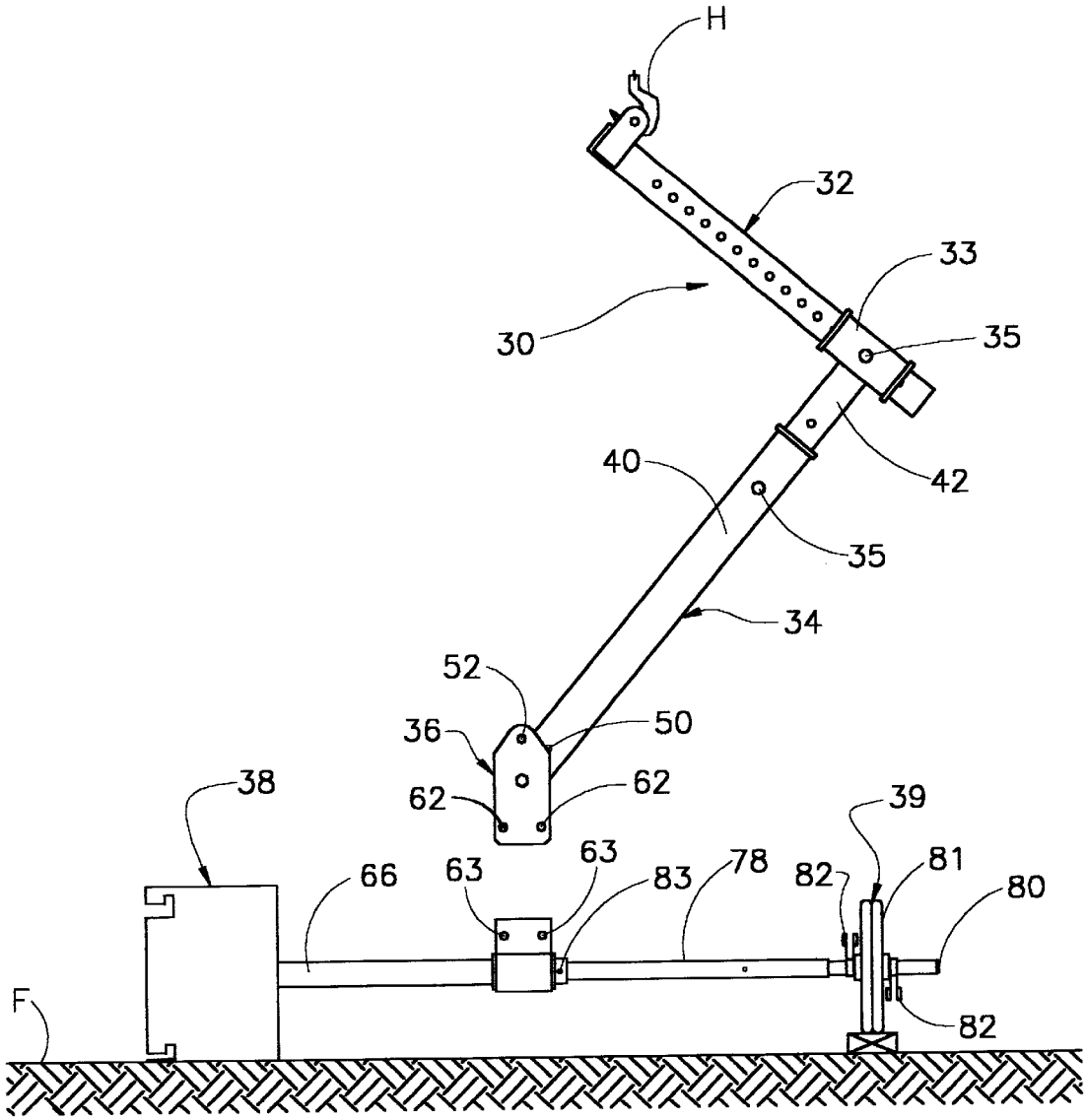
FIGS. 19 through 23 illustrate assembly and operation of the preferred embodiment of the present invention.

Referring to FIG. 19, lifting arm 32 and telescopic leg 34 assembly shall be lifted off the floor F with the crane. Connector 36 shall be made free to rotate around permanent pin 37 by removing pin 35 from the holes 50 and 52. Lifting arm 32 and telescopic leg 34 assembly shall be brought to the water jet adapter 38 assembled together with the counterweight 39 as shown in FIG. 19. The water jet adapter/counterweight assembly shall be connected to the connector 36 with two removable pins 35 inserted through aligned holes 62 and 63 of connector 36 and water jet adapter 38 respectively (refer to FIG. 19) and then lifted off the floor or pallet as shown in FIG. 20. At this point the position of weight plates 81 is adjusted by releasing spring clamps 82 and sliding them along round bar 80 until weight of water jet adapter 38 is balanced and the water jet adapter/counterweight assembly is suspended in the position close to level as shown in FIG. 20.

FIG. 20 shows articulated lifting device 30 suspended off hook H of the hoist or crane above (not shown) and ready to be attached to water jet WJ of boat B. While being suspended off the hook H, the articulated lifting device 30 is slowly moved towards the water jet WJ and water jet adapter 38 is lined up with the water jet. At this point the water jet adapter 38 can be rotated around its axis within sleeve 73 with the help of pry bar (not shown) which is inserted in hole 84 of the counterweight arm 78 in order to lineup cutouts 72 of the attachment head 65 with lifting lugs of water jet WJ. Attachment head 65 of water jet adapter 38 is then slid onto the front portion of the water jet WJ and turned counter clockwise with the pry bar inserted through hole 84 of counterweight arm 78 to engage lifting lugs of water jet WJ as shown in FIG. 21. Hook H of the hoist or crane (not shown) is slowly moved in the direction of the boat, as shown in FIG. 21, until telescopic leg 34 is in the vertical position and hole 50 is aligned with the hole 52 of connector 36. Removable pin 35 is inserted into aligned holes 50 and 52 thus fixing telescopic leg 34 in the position.

Figure 23:
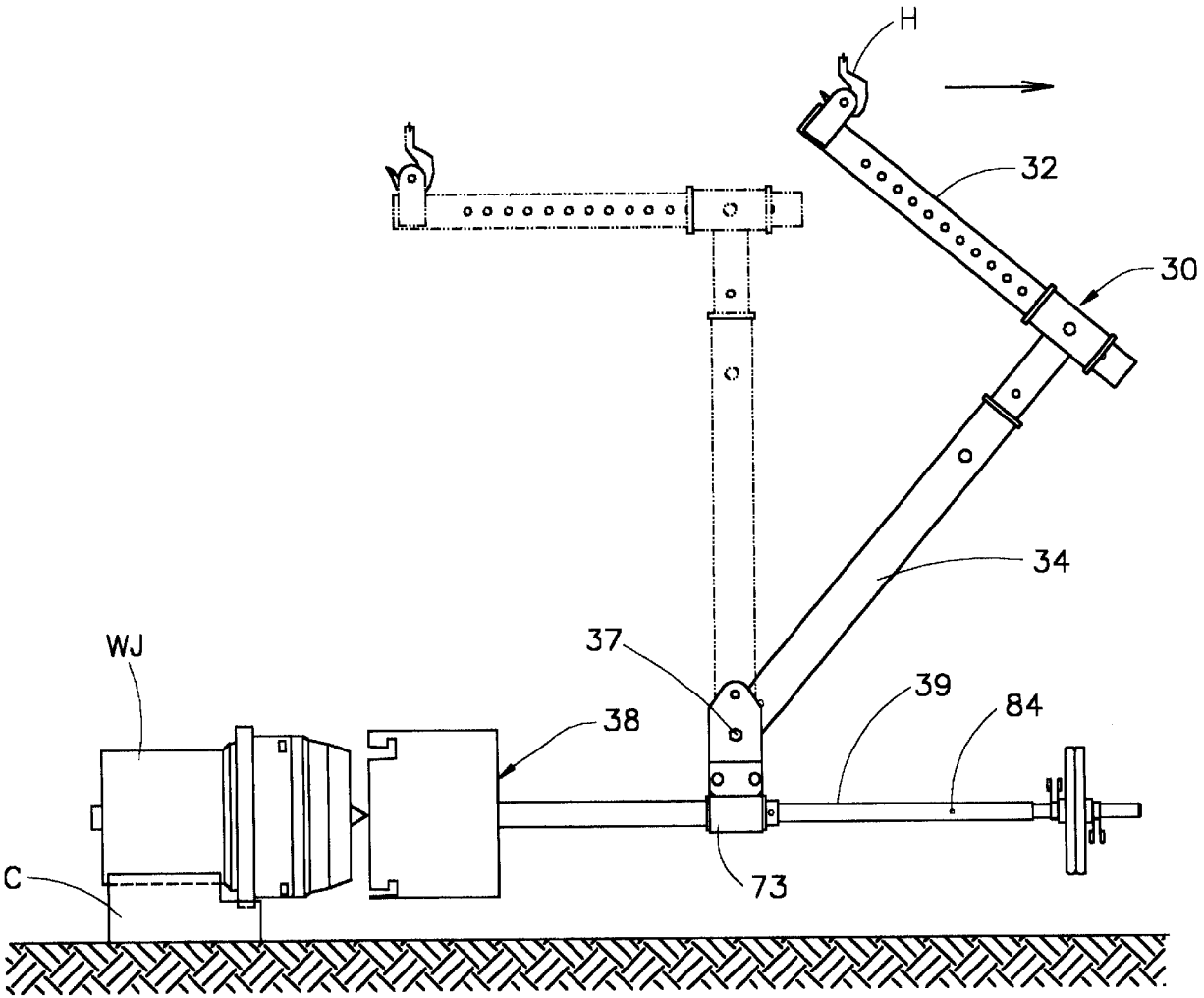

FIG. 21 shows articulated lifting device 30 attached to water jet WJ of the boat B and ready for the lift. Hook H of the hoist or crane above (not shown) is slowly moved upwards to the take the load off the boat and water jet WJ is disconnected from the boat B. Then articulated lifting device 30 with water jet WJ is slowly moved horizontally, away from the boat (see FIG. 22). After water jet WJ is set in the cradle C shown in FIG. 23, the load is taken off articulated lifting device 30 by slowly lowering hook R Removable pin 35, that pins together connector 36 with telescopic leg 34, is removed. Water jet adapter 38, together with counterweight assembly 39, is rotated clockwise within sleeve 73 with the help of the pry bar (not shown) which is inserted through hole 84 to disengage lifting lugs of water jet WI which is now set in the cradle C. Hook H of the hoist or crane above is slowly moved away from water jet WJ, thus causing rotation of telescopic leg 34 and adjustable lifting arm 32 around permanent pin 37 until attachment head of water jet adapter 38 is completely off the water jet WJ as shown in FIG. 23. To install water jet WJ back in the boat B, the above procedure is repeated in the reverse order.

ADDITIONAL EMBODIMENTS

Figure 24:
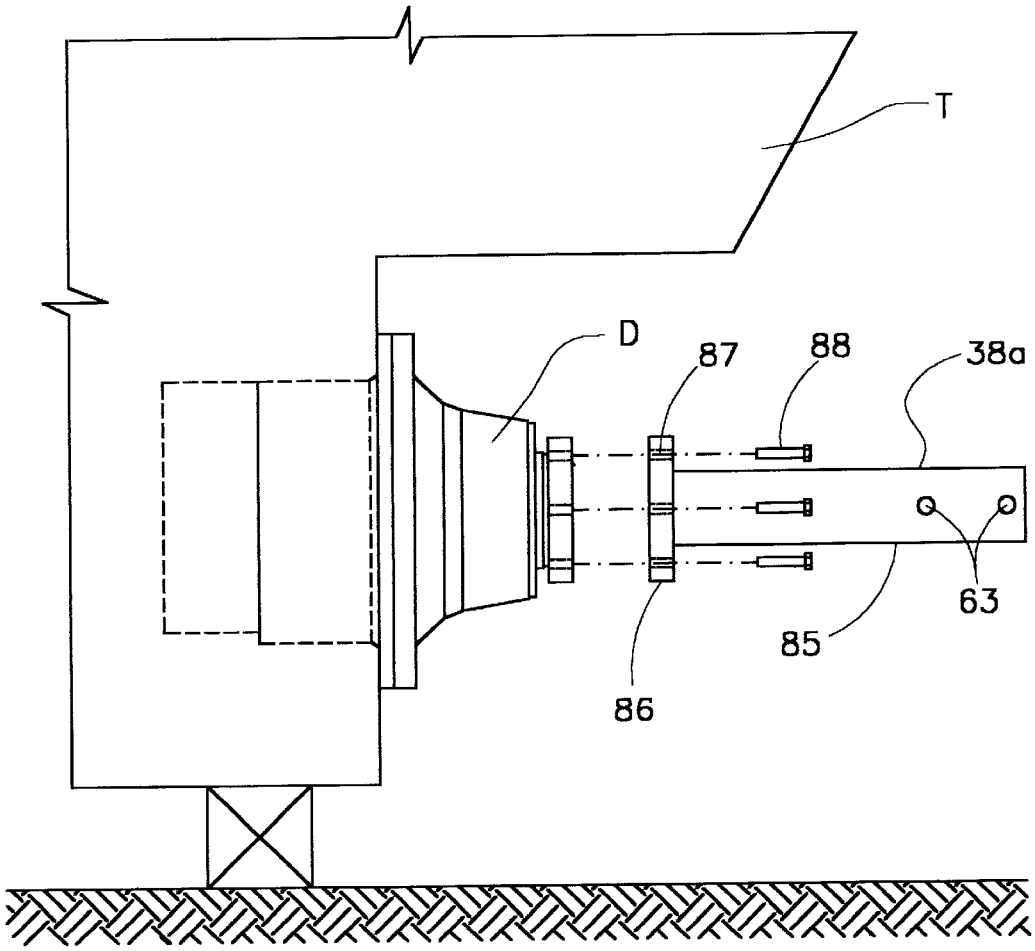
FIGS. 24 through 27 illustrate details and operation of additional embodiment of articulated lifting device equipped with an alternative load adapter.
Figure 25:
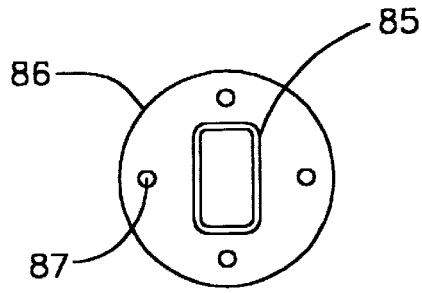
Figure 26:
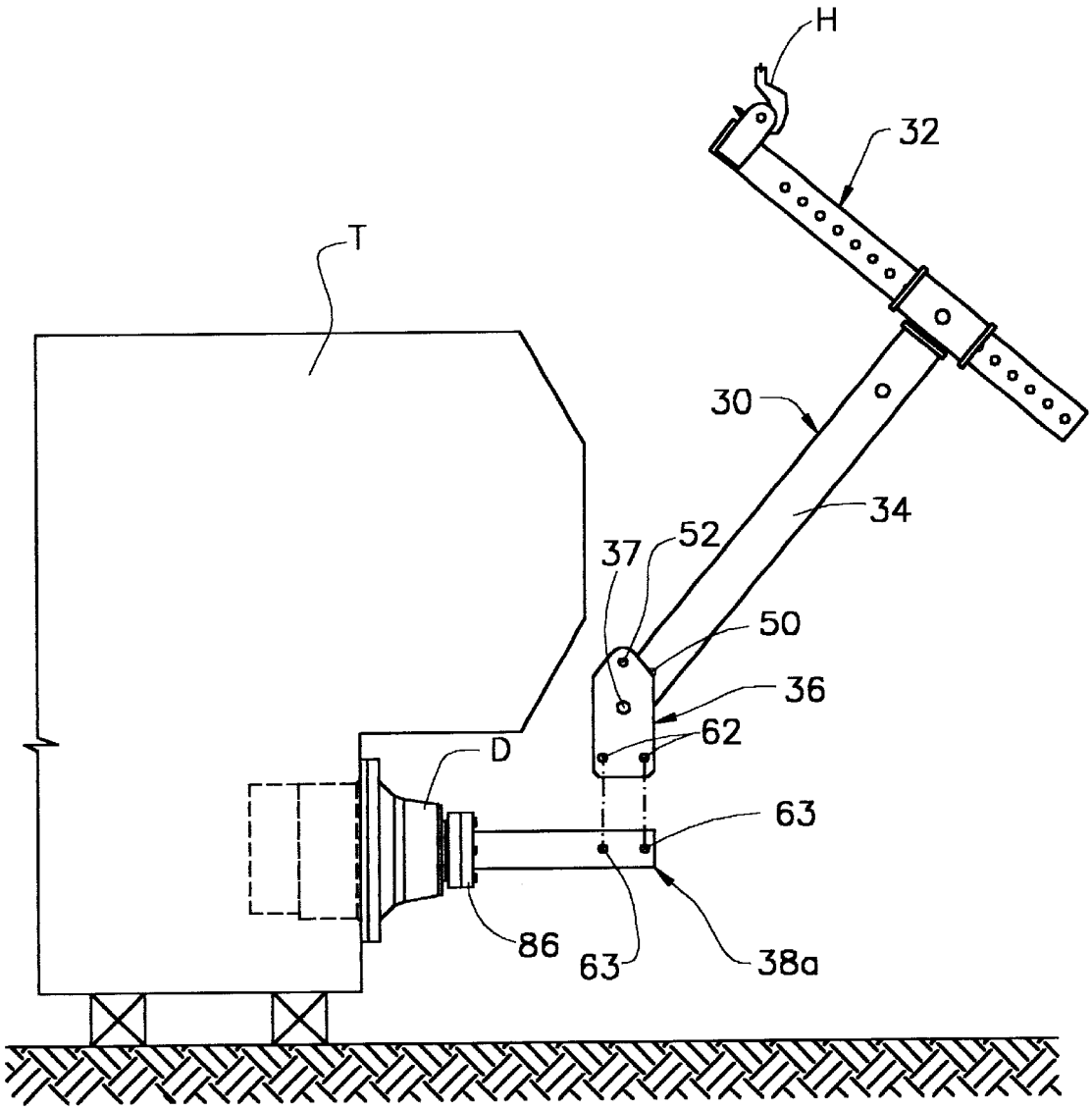
Figure 27:
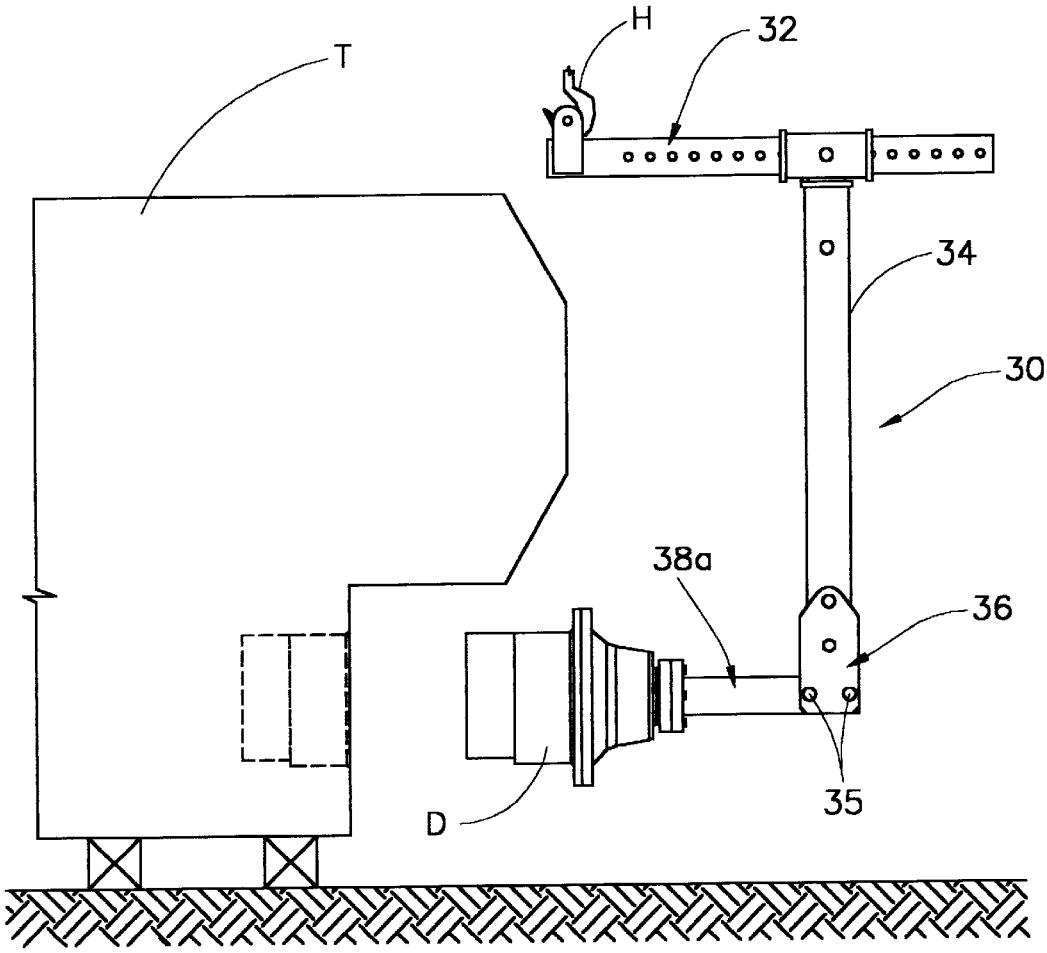

Additional embodiment is shown in FIGS. 24, 25, 26 and 27. FIG. 24 shows a partial end view of crawler tractor T with crawler drive D, which has to be removed for repair or replacement. Drive D has plurality of tapped holes provided in the front plate. A drive adapter 38*a* comprises an adapter plate 86 with plurality of matching holes 87, through which bolts 88 are inserted in order to attach adapter 38*a* to drive D, and a tubular adapter arm 85 with a pair of through holes 63. End view of adapter 38*a* is shown in FIG. 25. The pair of through holes 63 match holes 62 of connector 36 of articulated lifting device 30 as shown in FIG. 26. In the described embodiment adapter plate 86 comprises 9" diameter 1½" thick steel plate with four 13/16" holes drilled to match the pattern of ¾" diameter tapped holes provided in crawler drive D so that four ¾" diameter bolts 88 can be inserted through holes 87 and screwed into the tapped holes provided in the front plate of drive D (FIG. 24). Adapter arm 85 comprises 5"×3"×5/16" 2' long rectangular tube welded to adapter plate 86 at one end and provided with pair of holes 63 at the other end, which align with holes 62 of connector 36 to accept removable pins 35 as shown in FIG. 27.

Due to the relatively light weight of the adapter 38*a* (approximately 60 lbs), it can be attached to the drive D manually, without using crane or hoist, therefore the counterweight assembly described in the description of the preferred embodiment is not required and lifting procedure will be different.

To remove crawler drive D from crawler tractor T using articulated lifting device 30, drive adapter 38*a* is attached to the crawler drive D with four bolts 88 as shown in FIGS. 24 and 26. Knowing the weight and position of the Center of Gravity of crawler drive D as well as every part of articulated lifting device 30 and making assumptions in regard to extension of adjustable lifting arm 32 position of the Center of Gravity of all parts combined together, which will be suspended off the crane hook H as shown on FIG. 27, can be found, unless required extension of lifting arm 32 for lifting drive D is already known from previous experience. Extension of adjustable lifting arm 32 shall be adjusted accordingly and articulated lifting device 30 is brought to position for attachment to the adapter 38*a* as shown in FIG. 26. At this point connector 36 is free to rotate around permanent pin 37 to facilitate attachment to the adapter 38*a*. Articulated lift device 30 is slowly lowered down and attached to adapter 38*a* with two removable pins 35 inserted through aligned holes 62 and 63 in swivel hanger 36 and adapter 38*a* respectively, as shown in FIGS. 26 and 27. Hook H of the crane or hoist above is slowly moved towards the drive D to rotate telescopic leg 34 until it is in vertical position and hole 50 of telescopic leg 34 is aligned with the hole 52 of connector 36. Removable pin 35 is inserted into aligned holes 50 and 52 (FIG. 26) thus fixing telescopic leg 34 in the position (FIG. 27).

Hook H of the hoist or crane above is slowly moved upwards, just enough to take load off the body of tractor T and to disconnect crawler drive D from the body. Then articulated lifting device 30 with drive D attached to it is slowly moved horizontally, away from the crawler tractor T (FIG. 27). To install crawler drive D back in the tractor T, procedure, described herein, shall be repeated in the reverse order.

All of the components and/or materials of the articulated lifting device of the present invention are readily available on the market, and the fabrication and assembly thereof is relatively simple and convenient. Moreover it will be appreciated by those skilled in the art that the dimension and sizes of the various components disclosed herein are not for purposes of limitations but, rather, for purposes of making a complete disclosure to facilitate a review of the present invention by one skilled in the art and ready appreciation of the features and advantages of the invention. It will also be appreciated by those skilled in the art that the articulated lifting device of the present invention can be supplied with various interchangeable adapters that would be able to attach to different parts and/or loads.

ADVANTAGES

From the description above, a number of advantages of the present invention become evident:

a) Articulated lifting device of the present invention is equipped with lifting arm that is manually adjustable, thus making it possible to use this device to lift loads of various configurations and/or located under overhanging structures of different extension.

b) Articulated lifting device, described herein, is also equipped with telescopic leg that can be manually adjusted to meet different lift conditions such as low headroom or deep overhanging structures. Adjustments are made by removing and reinstalling only one pin.

c) Articulated lifting device of the present invention is equipped with connector that freely rotates around a permanent pin thus facilitating attachment of the lifting device to the adapters already attached to the parts intended for lift or enabling heavy adapters, balanced with the counterweights, to be hanging in the desirable position while being attached to the parts or loads to be lifted.

d) As described above, articulated lifting device of the present invention can be used with numerous interchangeable adapters that would make it possible to use it for great number of loads and lift conditions which would prevent designing, building and maintaining separate lifting devices for every type of lift and/or condition.

e) Removable and adjustable counterweights can be attached to heavy adapters that would enable moving and using them by suspending them off the articulated lifting device in the desired position that would also facilitate attachment of such adapters to the parts or items intended for the lift.

f) Unlike prior art, that requires much heavier counterweights for balancing complete lifting device and, sometimes, load itself, present invention uses small counterweight, if required to balance a load adapter only.

g) If load adapter is required to rotate in order to attach to the part being lifted, it is provided with a round tubular arm which is rotatably journaled in the bearings within the sleeve that can be attached to the connector of the articulated lifting device.

It will be easily appreciated by those skilled in the art that all these advantages combined will make it possible to use articulated lifting device that is the subject of the present invention in a wide range of applications and conditions.

CONCLUSION, RAMNIFICATIONS, AND SCOPE

Accordingly, the reader will see that articulated lifting device of this invention can be easily adjusted to lift, remove and reinstall wide variety of machine parts and other types of loads located in limited spaces. Furthermore, the articulated lifting device of this invention has additional advantages:

simple connections allow quick manual adjustment of the frame dimensions;

when disassembled, the articulated lifting device requires minimum storage space;

it can be easily transported and quickly assembled and disassembled;

most of the elements of the articulated lifting device of the present invention are reusable, new interchangeable load adapters can be fabricated to fit future loads.

Although the description above contains many specificities, these should not be construed as limiting the scope of the invention but as merely providing illustrations of some of the presently preferred embodiments of this invention. For example, the connector connecting orthogonal frame with the load adapter can have different construction, spring loaded device can be used instead of the removable pin to restrict pivotal action of the connector, etc.

Thus the scope of the invention should be determined by the appended claims and their legal equivalents, rather than by the examples given

I claim:

1. Articulated lifting device comprising:

a substantially orthogonal support frame having a downwardly extending leg and a forwardly extending upper a adapted for connection to a hoisting device, a load adapter which is able to attach to an object to be lifted having a rearwardly extending arm, a means of connecting said downwardly extending leg with said rearwardly extending arm of said load adapter that allow free rotation of said leg in relation to said arm within certain limits and can lock said leg in predetermined position thereby providing rigid connection, whereby said load adapter can be attached to the load to be lifted, and whereby said support frame is rotatable towards said load, and whereby said support frame can be locked in predetermined position thereby creating rigid frame connection with said load adapter, and whereby said hoisting device can lift said lifting device together with said load and move to another location.

2. Lifting device of claim 1 wherein rearwardly extending arm is adapted to receive a counterweight assembly for balancing said load adapter.

3. Lifting device of claim 1 wherein said leg comprises an inner tube that telescopes within an outer tube.

4. Lifting device of claim 3 wherein a through hole is provided in the upper part of said outer tube and said inner tube has a plurality of spaced apart holes that can align with said hole of said outer tube.

5. Lifting device of claim 4 wherein a pin can be inserted through aligned holes thereby preventing said inner tube from sliding within said outer tube.

6. Lifting device of claim 3 wherein a larger plate having a cutout is attached to the top end of said outer tube and a smaller plate is attached to the bottom end of said inner tube thereby centering said inner tube within said outer tube.

7. Lifting device of claim 1 wherein a sleeve is attached to top end of said downwardly extending leg, whereby said forwardly extending arm is made slideable within said sleeve.

8. Lifting device of claim 7 wherein said sleeve has a through hole and said upper arm has a plurality of spaced apart holes that can align with said hole in said sleeve.

9. Lifting device of claim 8 wherein a pin can be inserted through aligned holes of said upper arm and said sleeve thereby preventing said upper arm from sliding within said sleeve.

10. Lilting device of claim 1 wherein said rearwardly extending arm of said load adapter comprises a round elongated bar and a sleeve having a plurality of bearings within itself, whereby said round bar is rotatably journaled in said bearings.

11. Articulated lifting device comprising:

a substantially orthogonal support frame having a downwardly extending leg and a forwardly extending upper arm adapted for connection to a hoisting device, a load adapter which is able to attach to an object to be lifted having a rearwardly extending arm, a connector, pivotably connecting said downwardly extending leg with the adapter arm that allows free rotation of said leg in relation to said arm within certain limits and can lock said leg in predetermined position hereby providing rigid connection, whereby said load adapter can be attached to the load to be lifted, and whereby said support frame may be pivotably rotated towards said load, and whereby said support frame can be rigidly locked in predetermined position thereby creating rigid frame connection with said load adapter, and whereby said hoisting device can lift said lifting device together with said load and move to another location.

12. Lifting device of claim 11 wherein said leg has a pair of spaced apart through holes located close to the bottom end of said leg.

13. Lifting device of claim 12 wherein said connector comprises two spaced apart plates, connected together with a spacer, having a pair of spaced apart holes in each plate for connecting to the bottom end of said leg with a pair of pins that can be inserted through aligned holes provided in said leg and in said connector.

14. A method for removal of a part of machinery located under overhanging structure, comprising the steps of:

providing a load adapter having a rearwardly extending arm and having a counterweight assembly attached to a free end of the adapter arm, and providing a substantially orthogonal support frame having a downwardly extending leg and a forwardly extending upper aria suspended off a hoisting device at the free end of said upper arm, and pivotably connecting said leg of said frame with said adapter arm and adjusting the counterweight so it balances weight of said load adapter, and attaching said load adapter to said part of machinery, and rotating said support frame towards said part of machinery until said support frame reaches predetermined position, and restricting pivotal movement of said support frame by locking it in predetermined position thereby creating rigid frame connection between said support frame and said load adapter, and lilting said part of machinery to take load off supports supporting said part of machinery in place and moving said part of machinery away.

15. A method for removal of a part of machinery located under overhanging structure, comprising the steps of:

providing a load adapter having a rearwardly extending arm, and attaching said load adapter to said part of machinery, and providing a substantially orthogonal support frame having a downwardly extending leg and a connector pivotably attached to the bottom end of said leg and having a forwardly extending upper arm suspended off a hoisting device at the free end of said upper arm, and connecting said orthogonal frame to said adapter with said connector, and rotating said support frame towards said part of machinery until said support frame reaches predetermined position, and restricting pivotal action of said connector thereby locking said support frame in predetermined position thereby creating rigid frame connection between said support frame and said load adapter, and lifting said part of machinery to take load off supports supporting said part of machinery in place and moving said part of machinery away.

* * * * *